United States Patent [19]

Marshall

[11] 4,191,656

[45] Mar. 4, 1980

[54] NON-YELLOWING BIOCIDE FOR CONTROL OF BACTERIA IN SPIN FINISH EMULSIONS USED ON NYLON YARN

[75] Inventor: Robert M. Marshall, Chester, Va.

[73] Assignee: Allied Chemical Corporation, Morris Township, Morris County, N.J.

[21] Appl. No.: 948,835

[22] Filed: Oct. 5, 1978

[51] Int. Cl.[2] ..... D06M 16/00

[52] U.S. Cl. ..... 252/8.6; 8/115.6; 252/8.75; 252/8.9; 427/434 D; 428/395

[58] Field of Search ..... 252/8.9, 8.8, 8.75, 252/8.6; 8/115.6; 427/434 D; 428/395

[56] References Cited

U.S. PATENT DOCUMENTS

| | | | |
|---|---|---|---|
| 3,781,202 | 12/1973 | Marshall et al. | 252/8.9 |
| 3,835,148 | 9/1974 | Oxe et al. | 252/8.8 |
| 3,966,659 | 6/1976 | Oxe et al. | 252/8.8 |
| 4,126,564 | 3/1978 | Marshall et al. | 252/8.9 |

OTHER PUBLICATIONS

Chem. Abstracts, vol. 76, (1972), p. 91, item 87256d.

*Primary Examiner*—William E. Schulz

*Attorney, Agent, or Firm*—Virginia S. Andrews; Richard A. Anderson

[57] ABSTRACT

A finish composition for polyamide yarn which comprises an oil in water emulsion and an effective amount of 2[(hydroxymethyl)amino]ethanol biocide resists bacteria growth and causes the treated yarn to resist yellowing under steam heat treatment. The oil in water emulsion and biocide most preferably form, respectively, 99.9 percent and 0.1 percent by weight of the finish composition. The preferred oil in water emulsion is about 10 to 20 percent by weight of the oil portion, the oil portion consisting essentially of from about 55 to 65 percent by weight of coconut oil, about 20 to 35 percent by weight of polyoxyethylene hydrogenated castor oil, and about 7 to 15 percent by weight of potassium salt of polyoxyethylene tridecyl phosphate. The finish composition is especially useful for application to polyamide yarn to be processed into either staple carpet yarn or bulked continuous filament carpet yarn.

11 Claims, No Drawings

NON-YELLOWING BIOCIDE FOR CONTROL OF BACTERIA IN SPIN FINISH EMULSIONS USED ON NYLON YARN

BACKGROUND OF THE INVENTION

This invention relates to a finish composition for treating a polyamide yarn which resists bacteria growth and causes the treated yarn to resist yellowing under steam heat treatment. More particularly, this invention relates to a finish composition for polyamide yarn to be processed into carpet yarn.

The prior art is replete with finishes for synthetic filament yarn. However, the critical combination of and proportion of ingredients required to achieve the specific, beneficial results of this invention are not taught in the prior art.

The problem specifically addressed by the present invention is the spot yellowing of nylon carpet yarn, either bulked continuous filament or staple carpet yarn, during autoclaving of the yarn. By autoclaving is meant placing yarn in a pressure vessel and subjecting it to steam treatment of various times, temperatures, and pressures.

SUMMARY OF THE INVENTION

The present invention provides a finish composition and an improved process for treating polyamide yarn, in which the finish composition resists bacteria growth and causes the treated yarn to resist yellowing under steam heat treatment.

The improvement in the process for the production of polyamide yarn, comprises treating the yarn during spinning with from about 0.5 to 1.2 percent by weight of the yarn of a finish composition. The finish composition consists essentially of from about 99.5 to 99.995 percent by weight of an oil in water emulsion and from about 0.005 to 0.500 percent by weight of 2[(hydroxymethyl-)amino]ethanol, about 10 to 20 percent by weight of the emulsion being an oil portion.

This finish composition, which resists bacteria growth and causes polyamide yarn treated therewith to resist yellowing under steam heat treatment, consists essentially of:

a. from about 99.5 to 99.995 percent of an oil in water emulsion, about 10 to 20 percent by weight of the emulsion being an oil portion, the oil portion consisting essentially of from about 55 to 65 percent by weight of coconut oil, about 20 to 35 percent by weight of polyoxyethylene hydrogenated castor oil, and about 7 to 15 percent by weight of potassium salt of polyoxyethylene tridecyl phosphate; and b. from about 0.005 to 0.500 percent by weight of 2[(hydroxymethyl)amino]ethanol.

An alternate but equally effective finish composition, which resists bacteria growth and which causes polyamide yarn treated therewith to resist yellowing under steam heat treatment, consists essentially of:

a. from about 99.5 to 99.995 percent by weight of an oil in water emulsion, about 10 to 20 percent by weight of the emulsion being an oil portion, the oil portion consisting essentially of about 55 percent by weight of mineral oil, from about 11 to 12 percent by weight of fatty acid soap, about 15 percent by weight of sulfonated ester ethoxylate, about 12 percent by weight of polyethylene glycol ether, and from about 0 to 1 percent by weight of triethanolamine; and b. from about 0.005 to 0.500 percent by weight of 2[(hydroxymethyl)amino]ethanol.

The invention further comprises a method of making synthetic yarn finish compositions resistant to bacteria growth, whereby yarn treated therewith resists yellowing under steam heat treatment. The method comprises adding from about 0.005 to 0.500 percent by weight of the finish composition of 2[(hydroxymethyl)amino]ethanol to an oil in water finish emulsion.

More preferably, the oil in water emulsion and 2[(hydroxymethyl)amino]ethanol form, respectively, about 99.80 to 99.95 and about 0.05 to 0.20 percent by weight of the recited finish compositions.

DESCRIPTION OF THE PREFERRED EMBODIMENTS

As mentioned previously, it was found that during autoclaving at temperatures of about 138° C. (280° F.) polyamide yarn to be processed into carpet yarn yellowed. The yellowing occurred only in spots and always in the same pattern in the autoclave.

A test was run to determine the cause of the yellowing. Three different nylon polymers, amine terminated nylon polymer, an unterminated nylon polymer, and an acid terminated nylon polymer, were melt spun with three different finishes and dipped into a solution of biocide to obtain from 0.1 to 5 percent biocide on yarn. The spin finishes were liquid compositions consisting essentially of an oil in water emulsion, about 10 to 20 percent by weight being an oil portion. The oil portion of the three finishes had the formulations set forth in Table I.

TABLE I

FINISH FORMULATIONS

| Finish | Composition | Weight Percent |
|---|---|---|
| A | Mineral oil | 55 |
| | Fatty acid soap | 11 |
| | Sulfonated ester ethoxylate | 15 |
| | Polyethylene glycol ester | 12 |
| | Polyethylene glycol ether | 6 |
| | Triethanolamine | 1 |
| B | Mineral oil | 55 |
| | Fatty acid soap | 12 |
| | Sulfonated ester ethoxylate | 15 |
| | Polyethylene glycol ester | 12 |
| | Polyethylene glycol ether | 6 |
| C | Coconut oil | 59 |
| | Polyoxyethylene (25)[a] castor oil | 15.5 |
| | Decaglycerol tetraoleate | 7.5 |
| | Glycerol monooleate | 3.0 |
| | Polyoxyethylene (20)[a] sorbitan monooleate | 5.0 |
| | Sulfonated petroleum product | 10.0 |

[a] = Moles of ethylene oxide per mole of base material

The biocide utilized was 6-acetoxy-2,4-dimethyl-m-dioxane. The samples obtained were autoclaved at about 138° C. (280° F.). Results of the tests are presented in Table II. The results show that yellowing of the nylon is due to the biocide, is proportional to polymer amine end groups, and independent of spin finish. All of the nylon polymers tested showed yellowing at biocide concentrations of 1 percent, and the amine terminated nylon polymer showed yellowing at 0.1 percent biocide concentration.

Based on these results, several biocides were screened for yellowing on amine terminated nylon polymer yarn bearing spin finish A described in Table I. Results are presented in Table III. Samples F through M showed no significant yellowing at a biocide concentration of 0.5 percent on an amine terminated nylon polymer yarn. The biocide used in these samples (F through M) were then tested (two trials) for their ability to control bacteria growth in a finish A (Table I) emulsion. The results of this test are presented in Table IV. In table IV, the concentration (%) of biocide represents the percent by weight of biocide in a finish composition consisting essentially of finish A and the biocide. The initial concentration was 0.01 percent by weight of biocide. If after 10 days bacteria were not present in the emulsion, then smaller concentrations of biocide were tested. If after 10 days bacteria were present in the emulsion, higher concentrations of biocide were tested. The results show that four biocides were effective both with respect to bacteria growth and yellowing formaldehyde; 2[(hydroxymethyl)amino]-2-methylpropanol; 3,5-dimethyltetrahydro-1,3,5,2H-thiadizone-2-thione; and 2[(hydroxymethyl)amino]ethanol.

TABLE II

YELLOWING TEST

| Polymer Type | Spin Finish | Biocide Concentration Applied 0.1% | 0.5% | 1% | 3% | 5% |
|---|---|---|---|---|---|---|
| | | Yellowing Rating* | | | | |
| Amine terminated nylon polymer | A | 1 | 2 | 4 | 5 | 5 |
| Amine terminated nylon polymer | B | 1 | 2 | 3 | 4 | 4 |
| Amine terminated nylon polymer | C | 0 | 1 | 3 | 4 | 5 |
| Unterminated nylon polymer | A | 0 | 1 | 1 | 3 | 4 |
| Unterminated nylon polymer | B | 1 | 1 | 3 | 4 | 4 |
| Unterminated nylon polymer | C | 0 | 0 | 1 | 3 | 3 |
| Acid terminated nylon polymer | A | 0 | 0 | 1 | 3 | 3 |
| Acid terminated nylon polymer | B | 0 | 1 | 1 | 2 | 3 |
| Acid terminated nylon polymer | C | 0 | 0 | 1 | 2 | 3 |

*Yellowing Rating
0 No yellowing
1 Very slight yellowing
2 Slight yellowing
3 Yellowing
4 Heavy yellowing
5 Extremely heavy yellowing

TABLE III

| Sample | Biocide | CONCENTRATION OF BIOCIDE APPLIED 0.1% | 0.5% | 1.0% |
|---|---|---|---|---|
| | | Yellowing Rating* | | |
| A | 6-acetoxy-2,4-dimethyl-m-dioxane | 1 | 2 | 4 |
| B | 1,2-benzisothiazolin-3-one | 0 | 3 | 4 |
| C | 2-bromo-2-nitropropane-1,3-diol | 4 | 5 | 5 |
| D | dichlorophene phenol | 1 | 5 | — |
| E | 1,5-pentanediol | 1 | 5 | — |
| F | p-hydroxybenzyl acetate | 0 | 0 | 0 |
| G | p-hydroxybenzyl propionate | 0 | 0 | 0 |
| H | formaldehyde | 0 | 0 | 0 |
| I | sodium orthophenylphenol | 0 | 0 | 3 |
| J | 3,5-dimethyltetrahydro-1,3,5,2H-thiadiazine-2-thione | 0 | 0 | 2 |
| K | 2-[(hydroxymethyl)amino]-2-methylpropanol | 0 | 0 | 1 |
| L | 2[(hydroxymethyl)amino]ethanol | 0 | 0 | 2 |
| M | 1-(3-chloroalkyl)-3,5,7-triazo-1-azoniaadamantane | 0 | 0 | 0 |

*Yellowing Rating
0 No yellowing
1 Very slight yellowing
2 Slight yellowing
3 Yellowing
4 Heavy Yellowing
5 Extremely heavy yellowing

TABLE IV

BACTERIA CONTROL TESTS IN FINISH A

| Biocide | Concentration (%) | Presence of Bacteria After 10 Days |
|---|---|---|
| control (no biocide) | — | yes |
| p-hydroxybenzyl acetate | .01 | yes |
| p-hydroxybenzyl acetate | .02 | yes |
| p-hydroxybenzyl acetate | .03 | yes |
| p-hydroxybenzyl propionate | .01 | yes |
| p-hydroxybenzyl propionate | .02 | yes |
| p-hydroxybenzyl propionate | .03 | no |
| formaldehyde[1] | .01 | no |
| formaldehyde[1] | .005 | no |
| formaldehyde[1] | .0025 | yes |
| sodium orthophenylphenol | .01 | yes |
| sodium orthophenylphenol | .02 | yes |
| sodium orthophenylphenol | .03 | no |
| 3,5-dimethyltetrahydro-1,3,5,2H-thiadiazine-2-thione | .005 | yes |
| 3,5-dimethyltetrahydro-1,3,5,2H-thiadiazine-2-thione | .01 | no |
| 3,5-dimethyltetrahydro-1,3,5,2H-thiadiazine-2-thione | .02 | no |
| 3,5-dimethyltetrahydro-1,3,5,2H-thiadiazine-2-thione | .03 | no |
| 2-[(hydroxymethyl)amino]-2-methylpropanol | .005 | no |
| 2-[(hydroxymethyl)amino]-2-methylpropanol | .01 | no |
| 2-[(hydroxymethyl)amino]-2-methylpropanol | .02 | no |
| 2-[(hydroxymethyl)amino]-2-methylpropanol | .03 | no |
| 2[(hydroxymethyl)amino]ethanol | .005 | no |
| 2[(hydroxymethyl)amino]ethanol | .01 | no |
| 2[(hydroxymethyl)amino]ethanol | .02 | no |
| 2[(hydroxymethyl)amino]ethanol | .03 | no |
| 1-(3-chloroalkyl)-3,5,7-triazo-1-azoniaadamantane | .01 | yes |
| 1-(3-chloroalkyl)-3,5,7-triazo-1-azoniaadamantane | .02 | yes |
| 1-(3-chloroalkyl)-3,5,7-triazo-1-azoniaadamantane | .03 | yes |

1 Concentration represents active formaldehyde.

The first two of these biocides were deemed unacceptable due to a threat of skin irritation or other toxicological properties. The third biocide is not deemed to constitute a part of the present invention due to its disclosed use as an effective fungicide contained in a textile fiber finish (Defensive Publication No. T875,001 of Burress et al).

The biocide constituting a part of the present invention, 2[(hydroxy)methyl)amino]ethanol, is an alkanolamine. To demonstrate the criticality of this particular alkanolamine, further tests were run to evaluate selected alkanolamines with respect to biocidal potential and yellowing. Results are presented in, respectively, Tables V and VI. Finish X of Table V is more fully described in co-pending patent application U.S. Ser.

No. 859,762, filed Dec. 12, 1977, hereby incorporated by reference.

The invention will now be further described in the following specific examples which are to be regarded solely as illustrative and not as restricting the scope of the invention. In the following examples, parts and percentages employed are by weight unless otherwise indicated.

EXAMPLE I

A reactor equipped with a heater and stirrer is charged with a mixture of 1,520 parts of epsilonca-prolactam and 80 parts of aminocaproic acid. The mixture is then flushed with nitrogen and stirred and heated to 255° C. over a one-hour period at atmospheric pressure to produce a polymerization reaction. The heating and stirring is continued at atmospheric pressure under a nitrogen sweep for an addional four hours in order to complete the polymerization.

TABLE V

BACTERIA CONTROLS TESTS IN FINISHES A[1] and X[2]

| Biocide | Concentration in Finish (%) | Presence of Bacteria |
|---|---|---|
| Control | — | yes |
| Triethanolamine | .01 | yes |
| Triethanolamine | .05 | yes |
| Triethanolamine | .1 | yes |
| Triethanolamine | .2 | yes |
| Diethanolamine | .01 | yes |
| Diethanolamine | .05 | yes |
| Diethanolamine | .1 | yes |
| Diethanolamine | .2 | no |
| 2[(hydroxymethyl)amino]ethanol | .01 | no |

[1] = Same as Finish A of Table I; about twenty (20) percent by weight of emulsion was oil portion.

[2] = Finish X was an oil in water emulsion, about sixteen (16) percent by weight of emulsion was oil portion. The oil portion consisted essentially of the following ingredients:

| | Weight Percent |
|---|---|
| Refined coconut glyceride | 60 |
| Polyoxyethylene (16)[a] hydrogenated castor oil | 30 |
| Polyoxyethylene (5)[a] tridecyl phosphate, potassium salt | 10 |

[a] = moles of ethylene oxide per mole of base material

TABLE VI

YELLOWING TEST

| Biocide | Finish | Biocide Concentration Applied 0.1% | 0.5% | 1.0% |
|---|---|---|---|---|
| | | Yellowing Rating on Amine Terminated Nylon Polymer Yarn* | | |
| Triethanolamine | X (Table V) | 3 | 4 | 5 |
| Diethanolamine | X (Table V) | 2 | 3 | 5 |
| 2[(hydroxymethyl)amino]-ethanol | X (Table V) | 0 | 0 | 2 |

*Yellowing Rating
0 No yellowing
1 Very slight yellowing
2 Slight yellowing
3 Yellowing
4 Heavy yellowing
5 Extremely heavy yellowing Nitrogen is then admitted to the reactor and a small pressure is maintained while the polycaproamide polymer is extruded from the reactor in the form of a polymer ribbon. The polymer ribbon is subsequently cooled, pelletized, washed and dried. The polymer is a white solid having a relative viscosity of about 50 to 60 as determined at a concentration of 11 grams of polymer in 100 ml. of 90 percent formic acid at 25° C. (ASTM D-789-62T).

The polymer pellets are melted at about 285° C. and melt extruded under pressure of about 1,500 psig. through a 70-orifice spinnerette to produce an undrawn yarn having about 3,600 denier. The finish composition which is applied to the yarn consists essentially of:

a. about 99.9 percent by weight of an oil in water emulsion, about 16 percent by weight of the emulsion being an oil portion consisting essentially of about 60 percent by weight of refined coconut glyceride, about 30 percent by weight of polyoxyethylene (16)[a] hydrogenated castor oil, and about 10 percent by weight of polyoxyethylene (5)[a] tridecyl phosphate, potassium salt, wherein the superscript a refers to moles of ethylene oxide per mole of base material; and b. about 0.1 percent by weight of 2[(hydroxymethyl-)amino]ethanol, manufactured under the trade name of Troysan 174 by the Troy Chemical Company, One Avenue L, Newark, N.J. 07105. This finish composition, which on testing does not exhibit the presence of bacteria, is applied to the yarn as a spin finish in amount to provide about 0.9 percent by weight of oil based on the weight of yarn. The yarn is then drawn at about 3.2 times the extruded length and textured with a steam jet to produce a feeder yarn suitable for production of plied, bulked continuous filament carpet yarn. This yarn is then autoclaved at a temperature of about 138° C. The autoclaved yarn exhibits no yellowing.

EXAMPLE 2

The procedure of Example 1 is followed except that the polymer is spun and combined into a tow of yarn which is stretched, steam textured, chopped into 7 inch lengths and baled. From these bales, the fibers are carded to form a roving suitable for the production of staple carpet yarn. This yarn is then autoclaved at a temperature of about 138° C. The autoclaved yarn exhibits no yellowing.

EXAMPLE 3

The procedure of Example 1 is followed except that the finish composition which is applied to the yarn consists essentially of:

a. about 99.9 percent by weight of an oil in water emulsion, about 20 percent by weight of the emulsion being an oil portion consisting essentially of about 55 percent by weight of mineral oil, about 12 percent by weight of fatty acid soap, about 15 percent by weight of sulfonated ester ethoxylate, about 12 percent by weight of polyethylene glycol ester, and about 6 percent by weight of polyethylene glycol ether; and b. about 0.1 percent by weight of 2[(hydroxymethyl-)amino]ethanol, manufactured under the trade name of Troysan 174 by the Troy Chemical Company, One Avenue L, Newark N.J. 07105. The finish composition of this example also on testing does not exhibit the presence of bacteria, and the autoclaved yarn exhibits no yellowing.

EXAMPLE 4

The procedure of Example 2 is followed utilizing the finish composition of Example 3. The autoclaved yarn exhibits no yellowing.

I claim:

1. A finish composition for treating polyamide yarn, said finish composition resisting bacteria growth and causing said treated yarn to resist yellowing under steam heat treatment, said finish composition consisting essentially of:

a. from about 99.5 to 99.995 percent by weight of an oil in water emulsion, about 10 to 20 percent by weight of said emulsion being an oil portion, said oil portion consisting essentially of from about 55 to 65 percent by weight of coconut oil, about 20 to 35 percent by weight of polyoxyethylene hydrogenated castor oil, and about 7 to 15 percent by weight of potassium salt of polyoxyethylene tridecyl phosphate; and b. from about 0.005 to 0.500 percent by weight of 2[(hydroxymethyl)amino]ethanol.

2. The finish composition of claim 1 wherein said oil in water emulsion forms from about 99.80 to 99.95 percent by weight of said finish composition and wherein said 2[(hydroxymethyl)amino]ethanol forms from about 0.05 to 0.20 percent by weight of said finish composition.

3. The finish composition of claim 2 wherein said oil in water emulsion and said 2[(hydroxymethyl)amino]ethanol form, respectively, about 99.9 percent and 0.1 percent by weight of said finish composition.

4. The finish composition of claim 1 wherein said oil portion consists essentially of about 60 percent by weight of coconut oil, about 30 percent by weight of polyoxyethylene hydrogenated castor oil, and about 10 percent by weight of potassium salt of polyoxyethylene tridecyl alcohol.

5. The finish composition of claim 1 wherein said polyamide yarn is an amine terminated polyamide yarn.

6. A finish composition for treating polyamide yarn, said finish composition resisting bacteria growth and causing said treated yarn to resist yellowing under steam heat treatment, said finish composition consisting essentially of:

a. from about 99.5 to 99.995 percent by weight of an oil in water emulsion, about 10 to 20 percent by weight of said emulsion being an oil portion, said oil portion consisting essentially of about 55 percent by weight of mineral oil, from about 11 to 12 percent by weight of fatty acid soap, about 15 percent by weight of sulfonated ester ethoxylate, about 12 percent by weight of polyethylene glycol ester, about 6 percent by weight of polyethylene glycol ether, and from about 0 to 1 percent by weight of triethanolamine; and b. from about 0.005 to 0.500 percent by weight of 2[(hydroxymethyl)amino]ethanol.

7. The finish composition of claim 6 wherein said oil in water emulsion forms from about 99.80 to 99.95 percent by weight of said finish composition and wherein said 2[(hydroxymethyl)amino]ethanol forms from about 0.05 to 0.20 percent by weight of said finish composition.

8. The finish composition of claim 7 wherein said oil in water emulsion and said 2[(hydroxymethyl)amino]ethanol form, respectively, about 99.9 percent and 0.1 percent by weight of said finish composition.

9. The finish composition of claim 6 wherein said polyamide yarn is an amine terminated polyamide yarn.

10. In a process for production of thermoplastic synthetic filamentary yarn, the improvement comprising:

treating said yarn during spinning with from about 0.5 to 1.2 percent by weight of said yarn with a finish composition, said finish composition consisting essentially of from about 99.5 to 99.995 percent by weight of an oil in water emulsion and from about 0.005 to 0.500 percent by weight of 2[(hydroxymethyl)amino]ethanol, about 10 to 20 percent by weight of said emulsion being an oil portion;

whereby said treated yarn resists yellowing under steam heat treatment and wherein said finish composition resists bacteria growth.

11. A method of making synthetic yarn finish compositions resistant to bacteria growth comprising:

adding from about 0.005 to 0.500 percent by weight of said finish composition of 2[(hydroxymethyl-)amino]ethanol to an oil in water finish emulsion;

whereby yarn treated therewith resists yellowing under steam heat treatment.

* * * * *